US005096129A

United States Patent [19]

Gilbert et al.

[11] Patent Number: 5,096,129

[45] Date of Patent: Mar. 17, 1992

[54] PROCEDURE AND APPARATUS FOR COMMINUTING HARD MATERIAL BODIES

[75] Inventors: Herbert A. Gilbert, Beaver Falls; Charles S. Melnick, Renfrew; Dennis M. Melnick, Baden; Thomas W. Reichner, Pittsburgh; Steven J. Gilbert, New Brighton, all of Pa.

[73] Assignee: Cryo Quench Plus, Inc., Baden, Pa.

[21] Appl. No.: 341,620

[22] Filed: Apr. 20, 1989

[51] Int. Cl.[5] ..... B02C 23/20; B02C 19/00

[52] U.S. Cl. ..... 241/60; 241/275

[58] Field of Search ..... 241/275, 47, 57, 60, 241/186 R, 186.2, 188 R, 189 R, 191

[56] References Cited

U.S. PATENT DOCUMENTS

| | | | |
|---|---|---|---|
| 1,575,717 | 3/1926 | Plauson . | |
| 2,546,286 | 3/1951 | Zakel | 241/188 R X |
| 2,823,868 | 2/1958 | Scherer . | |
| 3,004,721 | 10/1961 | Nötzold | 241/60 X |
| 3,255,793 | 6/1966 | Clute . | |
| 3,788,562 | 1/1974 | Greenlay et al. | 241/27.5 X |
| 3,995,814 | 12/1976 | Alberts . | |
| 4,391,411 | 7/1983 | Colburn . | |
| 4,579,288 | 4/1986 | McDermid et al. . | |

FOREIGN PATENT DOCUMENTS

| | | | |
|---|---|---|---|
| 2018456 | 11/1971 | Fed. Rep. of Germany | 241/275 |

*Primary Examiner*—Joseph M. Gorski
*Attorney, Agent, or Firm*—Armstrong & Kubovcik

[57] ABSTRACT

The inventive structure involves the provision and use of a rotating, fluted, impeller having sling compartments along a side thereof in which frangible materials are progressively introduced, are subjected to impaction with respect to each other and from which, after a build-up of radial angular velocity of the bodies, are projected forwardly radially outwardly with maximized face against a striker abutment and each other within a side-positioned quadrant zone. Thereafter, the broken-up material bodies are advanced past a somewhat tangentially converging forward, space-restricting end of an adjustment plate which may be one member of a striker abutment assembly, by the impeller into a separating zone or passageway along which a fluid stream is counterflowed with respect to rotation of the impeller and employed to substantially immediately separate out broken-up particulates of a desired size from particles of greater than the desired size, with particles being returned to the impeller compartments and recycled with newly introduced material bodies and with the particulates being carried out of the apparatus by the fluid stream. The shaft of the impeller has a balanced, two-way, supporting, working area isolated, bearing mounting.

19 Claims, 2 Drawing Sheets

PROCEDURE AND APPARATUS FOR COMMINUTING HARD MATERIAL BODIES

This invention pertains to a simplified and improved approach to disintegrating relatively hard but breakable material bodies. A highly efficient procedure is involved as carried out by the development and use of a machine having a relatively low auditory type of operation. The material bodies processed may be in the nature of brittle or frangible hard materials, such as lump coal, limestone, cement clinkers, metal ores, slag-like and frozen bodies.

BACKGROUND OF THE INVENTION

In the prior art, the conventional procedure has been to use ball milling, stamping, crushing, and grinding operations for breaking up ore-like bodies. This involves, not only a highly objectionable raising of the environmental noise level, but also a great amount of wear and tear on the apparatus and its working parts. Ball milling also tends to produce rounded particles. Accurate and close size selection has been difficult to attain.

Other, more exotic apparatus has employed sudden air pressure changes, with or without a gravity or vacuum induced flow, various fluid utilizing operations, and the directing of the materials against an obstruction with high velocity jets, the exploding or bursting of brittle material by sudden changes of pressure, and so forth.

OBJECTS OF THE INVENTION

An object of the invention has been to devise a new, simplified and more efficient comminuting procedure and apparatus that will enable an effective breaking-up of material bodies substantially along their cleavage lines and that will eliminate disadvantageous features of prior procedures and apparatus.

Another object has been to devise a comminuting procedure and apparatus that will enable the breaking-up or fracturing of material bodies into particles and particulates along their natural cleavage lines, and an efficient and substantially immediate classification of resultant particulates and particles within the same apparatus, with the recycling of larger rejected particles, all as a continuous operation.

A further object has been to devise a relatively simple comminuting apparatus construction and operation which will substantially eliminate the sound effects of normal grinding, hammermill and like operations and which, in turn, indicates a substantially minimized wear and tear on the working parts of the apparatus.

A further object has been to employ an outflowing fluid stream for separating out and removing material particulates of a selected smaller size range from a countermoving flow of impact broken-up charged material bodies.

A still further object has been to develop a comminuting process in which relatively hard material bodies will be subjected to a substantially continuous fracturing with respect to each other and, by impeller means, will be subjected to a maximized fracturing by impingement against an abutment, as based on a maximized development of impeller, rotation-developed force.

These and other objects of the invention will appear to those skilled in the art from the described embodiments and the claims.

SUMMARY OF THE INVENTION

In accordance with the applicants' concept, ore or other brittle material bodies are introduced progressively towards the axis of rotation of and into a series of radially outwardly and diverging sling compartments or radially compartmentalized, segregated zones of an impeller member that is being rotated in one direction, e.g. counterclockwise, by a suitable variable speed motor or engine. The speed of rotation is controlled on the basis of attaining a maximized build up or development of angular velocity on the bodies while fully utilizing available rotative distance of travel of the impeller. As illustrated by the drawings, this distance may represent about two vector quadrants or 180° of 360° of impeller rotation. Each sling compartment is defined by a disc-like side wall of the impeller, by radially outwardly diverging flutes extending therealong that are tapered from the axis of rotation of the impeller into an outer, side-banding, flange-like rim wall that defines a radially outwardly open and circumferentially widened-out flow mouth with the opposed side wall and through which the material bodies are projected outwardly into an outwardly offset break-up or 180° to 270° zone against each other and against a striker abutment means.

The abutment means is shown as slidably adjustable as to its "in" and "out" positioning and as located within a third quadrant segment or sector of the housing from the standpoint of the direction of impeller rotation. The material bodies as thus progressively slung or projected under maximized angular velocity by the advancing slinging-out action of the rotating impeller, impact against each other and particularly, impact against the abutment means, and are thus effectively broken-up along their natural fracture, shear or breakage lines. The resultant particles and particulates have sharp, as distinguished from rounded, edges and only a relatively low, "shush"-like sound is entailed after the apparatus operation is initiated.

A forward end or edge of the forwardly projecting or inwardly extending abutment means or plate is shown as terminating in a relatively close clearance spaced relation with respect to outer edges of the impeller, e.g. about 0.0005 to 0.0125 of an inch, adjacent to a fourth quadrant sector or segment of the housing. Such clearance spacing need only be sufficient to sweep the inside of the housing and keep it clean. A fluid outflow passageway portion of the housing is shown extending in a tangential relation with respect to the impeller that is counter or opposite to the tangential relation of the striker abutment and importantly, in what may be termed, an intersecting or crossing relation with respect to the forward end or edge of the abutment means. Such outflow passageway portion represents an outwardly enlarged classification or size selection zone in the fourth quadrant of the housing that is offset from the impeller. Particulates in such zone of not greater than a desired size are separated from a group of greater size particles by an outflowing stream of a suitable fluid, such as air or an inert gas. They are, in effect, carried or floated out within the fluid stream. The passageway is preferably given a coating of non-conducting plastic along its length to prevent a build-up of static electricity.

In the fourth or 270° to 360° vector zone, a stream of the fluid is flowed in a substantially tangentially counterflow direction with respect to the rotational movement of the impeller or compartmentalized rotor. The finer particulates are picked-up and floated outwardly in such tangential path from the apparatus for collection as desired.

The particles of heavier weight which have been rejected in the fourth or selecting zone are therein returned to the sling compartments of the impeller, as promoted by its rotative movement and by an outwardly offset shelf portion of the housing within which particles may lodge and serve as shock-absorbing bumpers for other particles that are being returned by the impeller to the first or feed-in quadrant or sector of the apparatus. Such particles therein combine with the material bodies that are being continuously introduced or fed into the apparatus, as by a downflow conduit into the compartments of the impeller. The size-rejected particles are then recycled.

In operation of the device or apparatus, the speed of the rotor may be varied to assure the most effective or efficient break up of the charge materials. In this connection, after a testing run for a specific material, the speed may be then maintained as long as such a material is being processed.

The material break-up blade or abutment means may comprise a single, substantially tangentially inwardly-forwardly extending member of a suitable strong material such as of steel whose innermost end portion defines a slightly clearance spaced relation with respect to the outer edges of the rotor blades or vanes, so that the particulates are carried around the outside of the impeller/rotor and the larger particles will be reintroduced back into the spaces between the flutes or vanes. Depending on the rate of outflow of the fluid stream, particulates of not greater than a desired size will be carried out in the fluid stream, while particles of an undesired larger size, but smaller in volume, will, due to their comparative heavier weight, be carried back by the impeller to the initial feed-in zone and recycled as mixed with the material bodies being initially introduced thereat.

One or a staggered group of breaker members, blades or parts may be employed, which are preferably mounted in an inwardly-outwardly sloped adjustable relation or positioning in the housing, and all of which extend tangentially inwardly and forwardly towards and in the direction of rotation of the rotor/impeller. The forward end of the leading projecting mean, member or plate, is shown in a relatively closely spaced relation with respect to the outer edges of the impeller flutes, vanes or blades, and may be designated as a clearance spacing the same as provided between the impeller and the rounded inner wall portions of the impeller housing for the first through the second quadrants of movement. The initial phase of 0° to 180° of impeller movement may be termed its sling power build-up movement with reference to the material bodies within its compartments, with such power being imparted thereto by the impeller rotation and its rate.

When the material bodies are introduced by gravity into the apparatus, they are subjected to a toroidal force action by reason of their simultaneous introduction with the fluid. Both are shown as introduced substantially midway between the axis of rotation of the impeller and its outer periphery. The action continues on the bodies throughout their advancement with the impeller, as believed to be caused by the counter, main stream movements of the impeller and the fluid stream within the housing. This has been found to cause a constant interreaction between the bodies, such that they also tend to break-up, and not limited to their cleavage lines, in what may be termed a secondary action in the apparatus.

DETAILED DESCRIPTION OF THE APPARATUS

Figure 3:
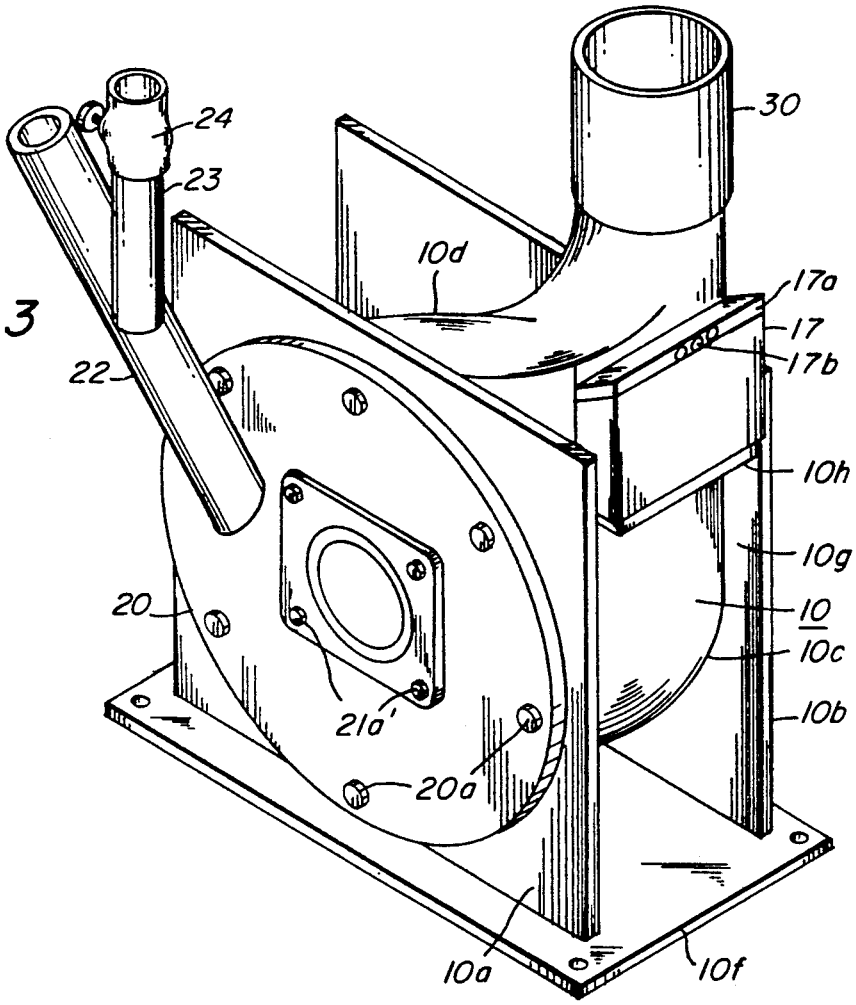
FIG. 3 is a perspective view showing the outside of the impeller apparatus.
Figure 4:
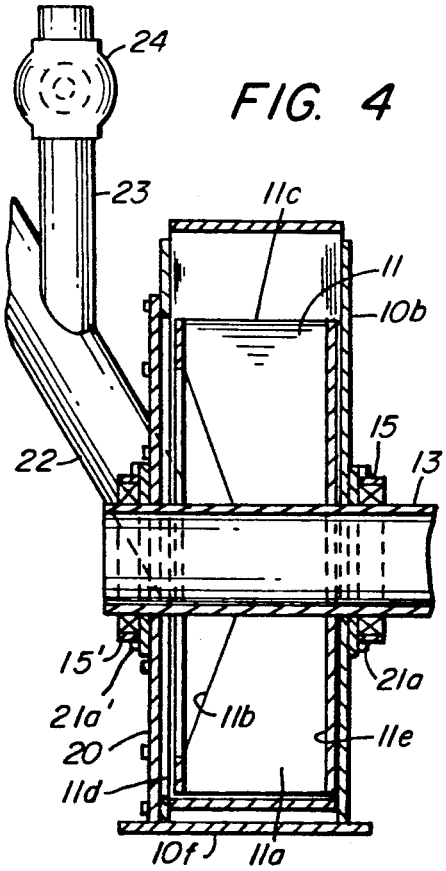
FIG. 4 is a vertical section on the scale of and taken along the line IV—IV of FIGS. 1 and 3.

Referring particularly to FIGS. 3 and 4 of the drawings, a comminuting apparatus or machine as constructed in accordance with the invention is illustrated as a single operating unit. It breaks up or refines brittle material bodies such as ore bodies of a larger than desired size and, in the same machine, automatically grades them in such a manner that particulates of a desired maximum size are separated out from the charged materials and particles of a larger size are combined with newly charged-in feed materials and recycled.

Figure 2:
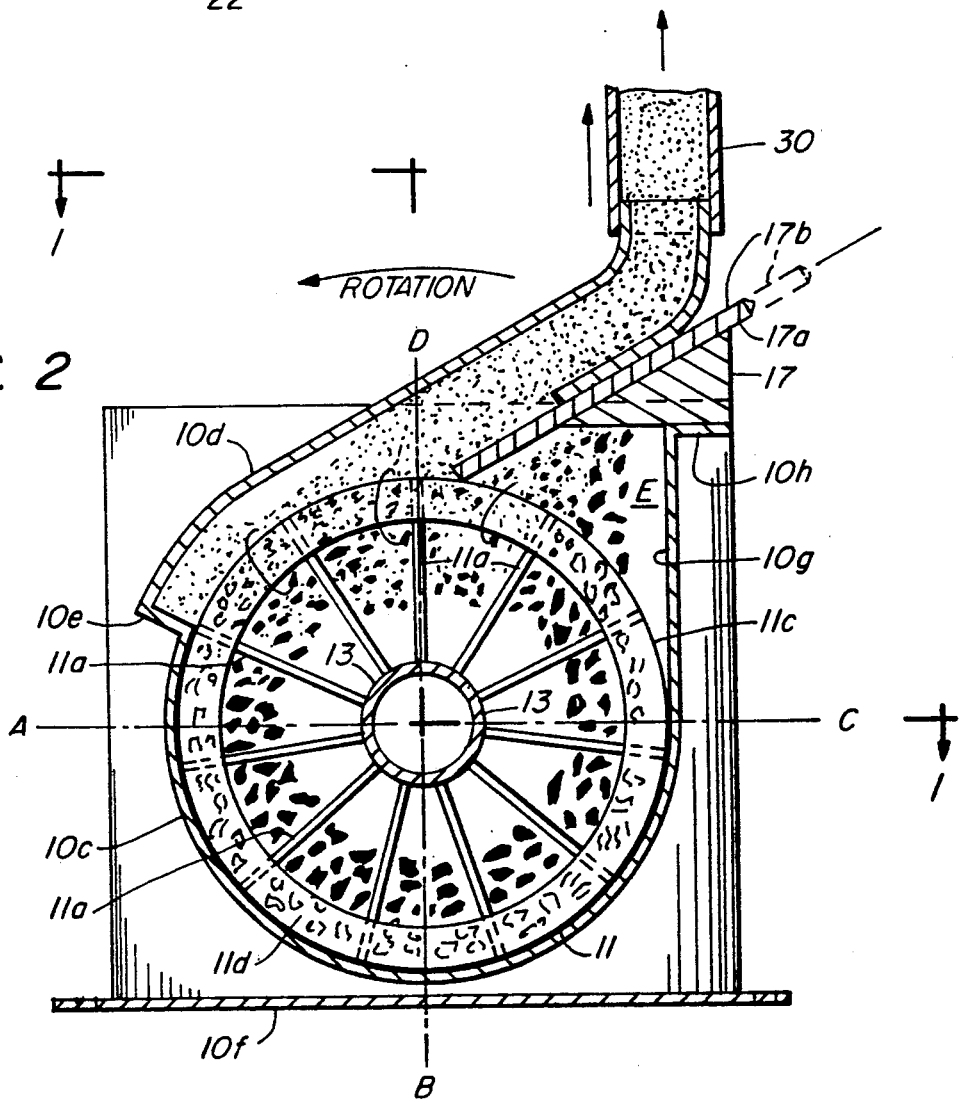
FIG. 2 is a vertical section on the scale of and taken along the line II—II of FIG. 1.

The machine has an outer housing 10 made up of a rectangular-shaped front plate portion 10*a*, an opposed rectangular-shaped and spaced apart upright back plate portion 10*b*, and a mounting base plate portion 10*f*. Centrally disposed between upright plate portions 10*a* and 10*b* is a central housing body portion 10*c*. As shown in FIG. 2, the body portion 10*c* is substantially circular in shape and its four quadrants are indicated by A through D to A. Semicircular quadrants represented by quadrants A, B and C define a close and, as shown, substantially uniform clearance relation with the outer periphery of a rotating impeller wheel or part 11. In the quadrant C to D, a back, vertically extending wall portion 10*g* and its outwardly extending shelf portion 10*h* define a disintegrating or impaction chamber or spacing E with respect to the outer peripheral edges 11*c* of blades 11*a* of an impeller 11. The shelf portion 10*h*, as shown in FIG. 2, serves to slidably position a striker blade or abutment 17 of wedge shape. And the abutment 17, in turn, slidably adjustably positions a downwardly sloped, adjustable plate 17*a*. The plate 17*a* is positioned with its forward edge in a relatively close clearance defining relation with the outer peripheral edges 11*c* of the impeller blades 11. Both the abutment 17 and the plate 17*a* slope forwardly and substantially tangentially towards and in the direction of rotation of the impeller 11 and, with outwardly offset vertical body portion 10*g* of the housing, define a comminuting break-up or pulverizing chamber zone E into which the charge materials are projected from within the confines of what may be termed the segregated zones or sling chambers defined by the impeller blades 11*a*. The construction and operation of the apparatus is such that the charge materials or bodies are thrown into the break-up area or zone E with a maximum angular velocity, as developed by about a 180° rotative movement of the impeller 11 from quadrants A through B to C.

The housing 10 has, at what may be termed, its upper back side of a fourth zone in the direction of impeller rotation or quadrant D, A, a fluid flow, duct-like portion 10*d* that extends tangentially along the outer confines of the impeller 11 and counter to its direction of rotation and thus, counter to the forward, counterclockwise rotation of the impeller 11 and advance of the charge materials, see FIG. 2. The restrictive positioning of the forward edge of the member 17*a*, with the side-extending duct-like portion 10*d* thus defines a separating-out zone in which above size particles are rejected and particulates of not larger than the desired size are picked-up by an outflowing fluid stream and carried thereby out through a conduit-like outlet end portion 30 for delivery to a suitable collecting point. The larger and rejected size particles of the charging materials are, as also shown in FIG. 2, projected against the lower portion of the duct-like offset portion 10*d*, by the counterclockwise rotation of the impeller 11, as distinguished from a clockwise flow of the fluid stream therealong. The larger rejected particles have a tendency to collect in an offset step portion 10*e* in such a manner that subsequent particles are, in effect, bounced-off those collected and are then returned, as shown, to positions between the flutes or blades 11*a* of the impeller 11 for recycling. It will be noted that the actual selection and removal of the particulates of the charged material or bodies is accomplished within the sector represented in FIG. 2 as D, A.

In accordance with the operation of the device, material bodies are introduced at about A, through a vertically downwardly extending and sloped pipe or conduit 22 (see FIGS. 3 and 4) to which a supply pipe for fluid such as air or an inert gas 23 is connected. The amount of flow of such fluid is controlled by a valve 24 so as to, in turn, control the rate or force of outflow along separation area defining portion 10*d* and thus control the maximum size of the particulates that are picked up and carried by the fluid out through the conduit end portion 30 for disposal.

The impeller 11, as particularly illustrated in FIGS. 2 and 4, has a series of radially-outwardly extending flutes or blades 11*a* that are mounted on a central shaft 13 and define collection-sling chambers or areas within which the breakable material bodies are received and advanced through substantially a 180° of rotative movement, as represented by A, B and C of FIG. 2. We have determined that such a distance of rotative movement of the impeller 11 will enable development of suitable maximized centrifugal force for projecting the material bodies into a breaking-up, outward projection within the zone E. By way of example, employing a rotative speed of the impeller of about 12 inches in diameter and at about 3000 r.p.m. will, for example, result in the breaking up of a somewhat brittle material, such as soft coal lumps of a size up to about 0.75 inches in cross section to give a yield of about 80 to 90% of separated-out of particulates of up to about 0.0017 of an inch in size and a yield of a maximum of about 20 to 10% of larger rejected particles that are then recycled. The fluid-borne dust thus represents the main part of the charged material. The resultant output is about 1 ton per hour and surprisingly, after the start-up, the operation is substantially noiseless, since for coal break-up, only the running sound of the motor is heard, with a slight "shush". Doubling the diameter of the impeller to 24 inches will permit the r.p.m. to drop to a half, or 1500 r.p.m., to maintain the same edge speed, which is the impact speed of the lumps against the breaker abutment.

Each blade 11*a* has an axially forwardly-outwardly sloped edge portion 11*b* (see FIG. 4) which terminates in a circular ring-like outer, circumferential flange 11*d*. The flange 11*d*, as shown, with a back, disc-like plate portion 11*e*, defines a closed, outer material delivery area or slot for each blade from which the material bodies are thrown or impelled, as shown in FIG. 2, with a maximum force against the striker abutment 17 which may comprise one or a group of staggered members. The bodies are not only broken-up by their impingement against the abutment 17, but also by their interaction with respect to each other. This results in a maximized break-up of the bodies into particles and particulates, with the particulates comprising about 80 to 90% of the charged bodies, and in such a manner that the breakage is along their natural cleavage lines.

Referring to FIGS. 2 and 3, the abutment plate or means 17 is adjustable on outwardly extending shelf portion 10*h* of the housing portion 10*g* and cooperates with a forwardly projecting and sloped adjustment plate means 17*a* which serves as an extension of the comminuting parts of the apparatus and primarily, as a close clearance defining means with respect to the outer circumference or periphery of the impeller 11 as located between a third comminuting and a fourth particulate separating-out zone of the housing. This permits the smaller particulates to pass thereunder into the conduit portion 10*d* and to cause the larger particles to be advanced after they are forced thereby, as shown, to return to the zones or spaces between the blades 11*a* of the impeller 11. It will be noted that the flow of the bodies from the zone areas of the blades 11*a* is an outwardly impelled movement within the third zone or quadrant C, D which, with a fourth zone or quadrant D, A serves to comminute and particulate-separate out the charged bodies.

Figure 1:
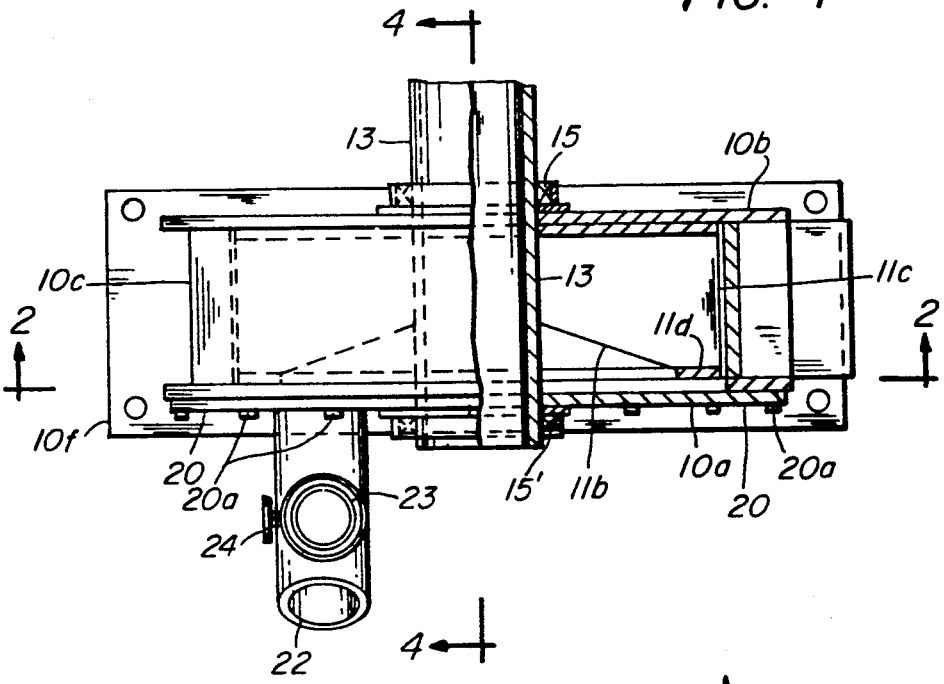
FIG. 1 is a horizontal section of impeller apparatus of the invention taken along the line I—I of FIG. 2.
Figure 5:
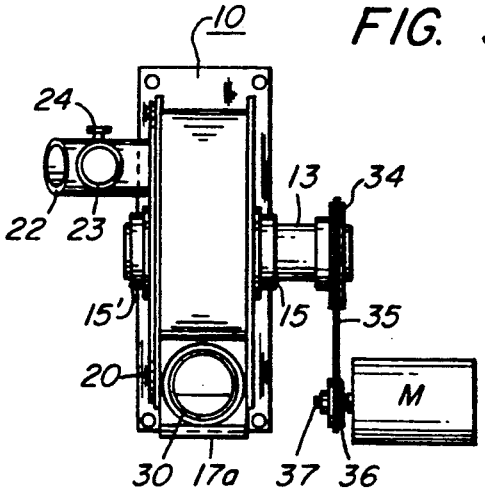
FIG. 5 is a greatly reduced top plan view showing a motor drive system for the impeller apparatus.

With reference to FIGS. 1, 4 and 5 of the drawings, a drive shaft 13 is shown mounted on a pair of bearing pillow blocks 15, 15' that are mounted by bolts 21*a* on the outside of the disc-like back wall member 10*b* of the housing and by bolts 21*a* on a removable, circular, front access plate 20, see also FIG. 3. The front plate 20 is, in turn, removably secured over a circular opening in the front plate portion 10*a* of the housing 10 by bolts 20*a*. This provides easy access for the interior of the apparatus. The drive shaft 13, as particularly shown in FIG. 5, is driven by a pulley wheel 34 mounted thereon, a belt 35, and a pulley wheel 36 which is mounted on the shaft of a variable speed electric motor M.

To facilitate adjustment of the projecting member 17*a* which may be considered as an adjunct breaker abutment, it, as shown in FIGS. 2 and 3, is provided with a handle 17*b*. Arrows in FIG. 2 designate the type of adjustment that may be effected. It will be noted that the central body portion 10*c* of the housing of the apparatus has a close clearance defining relation with respect to the outer edges of the impeller blades 11*a* from the point of introduction of the material bodies therein to the quadrant or sector C position. As shown in FIGS. 2, 3 and 4, the introduction is slightly above the sector or quadrant A position.

Another important feature of the inventive structure is that we have been able to provide the impeller with a pair of spaced, shaft bearing mounts 15 and 15' which are mounted on the outside of the working area of the impeller 11. This is distinguished from a single bearing mount or a working area mount required in the operation of some prior art constructions. Our apparatus or machine has a long wear life, requires little maintenance, is conservative of power requirements, and has a very low operative sound level of operation.

We claim:

1. A comminuting apparatus for breakable material bodies such as ore bodies which comprises, a housing, an impeller operably mounted in the housing for rotation therein, said impeller having radial flutes defining a continuous series of radially outwardly extending and open enlarged centrifugal sling compartments positioned thereabout, a first zone in said housing for progressively introducing the material bodies into said sling compartments during rotation of said impeller, a second zone in said housing that is sequentially ahead of said first zone in the direction of rotation of said impeller, said second zone being an angular outward force building up zone for material bodies being carried in said sling compartments and within which zone said housing defines a substantially uniform relatively close clearance defining relation with said impeller to retain the material bodies within the sling compartments during movement of said sling compartments along said second zone, an outwardly offset material breaking up third zone in said housing that is sequentially ahead of said second zone in the direction of rotation of said impeller, striker abutment means positioned in said third zone in an outwardly spaced operating position with respect to said impeller, said striker abutment means being adapted to break-up material bodies that are slung under centrifugally developed angular force outwardly thereagainst from said sling compartments of said impeller during its forward rotative movement along said third zone, an inwardly extending means at a forward end of said third zone having relatively close clearance defining relation at its forward end with respect to said impeller in its direction of rotative movement to assure a return of larger broken up material bodies into the compartments of said flutes, a fluid outflow fourth zone in said housing that extends substantially tangentially in an opposite direction with respect to the direction of rotative movement of said impeller, and means for flowing a fluid body along said fourth zone in such a manner as to pick up particulates of the material bodies being broken up and advanced by said impeller from said third zone of a desired smaller size to selectively separate them from particles of larger size being advanced from said third zone.

2. A comminuting apparatus as defined in claim 1 wherein said inwardly extending means is adjustably mounted to slope inwardly within said housing and in a spaced and forwardly converging relation with respect to said impeller in the direction of its rotative movement.

3. A comminuting apparatus as defined in claim 1 wherein said inwardly extending means is positioned in said third zone in a forwardly tangentially extending and converging relation with respect to said impeller in the direction of its rotative movement to, at its forward end, terminate in a close clearance defining relation of about 0.005 to 0.0125 of an inch with respect to said impeller.

4. A comminuting apparatus as defined in claim 1 wherein said inwardly extending means comprises a group of forwardly staggered abutting parts including a striker abutment part in a progressive forwardly converging positioned relation with respect to said impeller in the direction of its rotative movement.

5. A comminuting apparatus as defined in claim 4 wherein each of said parts is adjustably mounted in said housing and with respect to each other.

6. A comminuting apparatus as defined in claim 1 wherein, each of said compartments is enclosed on one side by a circular disc-like wall and is enclosed along its opposite side adjacent its outer edges by a banding flange-like wall and is open along its opposite side from said flange-like wall to a central axis of rotation of said impeller, and said flange-like wall with said disc-like wall defines a sling mouth through which the bodies are thrown radially outwardly into said third zone.

7. A comminuting apparatus for breakable material bodies such as ore bodies which comprises, a housing, an impeller operatively mounted in said housing for rotative movement therein, means for driving said impeller for effecting its forward rotative movement within said housing, said impeller having a series of radially outwardly and open sling compartments in a spaced relation thereabout, an input open feed portion at a first quadrant segment of said housing for progressively introducing material bodies sidewise towards an axis of rotation of said impeller into each of said compartments during forward rotation of said impeller within said housing, said housing having a relatively close clearance defining relation with outer edges of said sling compartments for about two quadrant segments thereof beyond said input feed open portion in the direction of rotation of said impeller and having a third quadrant segment in the direction of rotation of said impeller that defines an outwardly offset material breaking-up space-defining zone with respect to outer edges of said impeller, striker abutment means in said zone against which material bodies are progressively slung from said sling compartments and broken-up into material particulates and particles under centrifugal force developed thereon during rotation of said impeller along the two quadrant segments of said housing, plate means extending substantially tangentially of said impeller forwardly towards a fourth quadrant segment of said housing in the direction of rotation of said impeller and having a forward edge portion terminating in a close clearance defining relation with respect to the outer edges of the compartments of said impeller, and said housing having an outflow passageway portion extending along said impeller within a fourth quadrant segment thereof in the direction of rotation of said impeller and in a substantially reverse tangential relation with respect to the direction of rotation of said impeller, and means for flowing a fluid body upwardly along said passageway portion in an opposite direction with respect to the direction of rotation of said impeller in such a manner as to pick-up particulates of the material of a desired smaller size forwardly of the forward edge portion of said plate means and directly carry them upwardly out of said housing while rejecting particles of an undesired large size.

8. An apparatus as defined in claim 7 wherein said housing has means within said fourth quadrant segment for promoting a progressive return of rejected larger size particles of the broken-up material into the compartments of said impeller during is rotative movement.

9. An apparatus as defined in claim 7 wherein, said housing has an inwardly offset shelf portion within said fourth quadrant segment for collecting size-rejected particles thereon that serve as resilient bumpers for subsequently advancing size-rejected particles and that direct them towards and into advancing sling compartments during rotative movement of said impeller.

10. An apparatus as defined in claim 7 wherein said open feed portion is a conduit extending in an angular relation of about 60° with respect to the horizontal into said housing and through which the material bodies and the fluid body are directed and continuously introduced sidewise into said sling compartments towards the axis of rotation of said impeller.

11. An apparatus as defined in claim 7 wherein, said housing has a pair of transversely spaced-apart front and back wall members, a pair of bearings are mounted on outer sides of said front and back members, an operating shaft extends across between said front and back wall members and is journaled within said pair of bearings, said impeller is mounted on said shaft for rotation therewith, and means is connected to an outer end of said shaft for rotating it within said bearings.

12. A comminuting apparatus for breakable material bodies such as ore bodies which comprises, a housing, an impeller operably mounted in the housing for rotation therein, said impeller having radial flutes defining a continuous series of radially outwardly extending outwardly open and enlarged centrifugal sling compartments positioned thereabout, a first zone in said housing for progressively introducing the material bodies into said sling compartments during rotation of said impeller, a second zone in said housing that is sequentially ahead of said first zone in the direction of rotation of said impeller, said second zone being an angular outward force building up zone for material bodies being carried in said sling compartments and within which zone said housing defines a substantially uniform relatively close clearance defining relation with said impeller to retain the material bodies within the sling compartments during movement of said sling compartments therealong, an outwardly offset material breaking up a third zone in said housing that is sequentially ahead of said second zone in the direction of rotation of said impeller, striker abutment means positioned in said third zone in an outwardly spaced open position with respect to said impeller and against which the material bodies are progressively projected from the sling compartments of said impeller during its rotation, said striker abutment means being adapted to break-up material bodies into particles and particulates that are slung by said impeller under centrifugally developed angular force outwardly thereagainst within said third zone, a fourth and particulate separating out zone defined by said housing that extends substantially tangentially along and in an outwardly spaced relation with respect to said impeller, projecting means carried by said housing and positioned between said third and fourth zones in a relatively close clearance defining relation with respect to said impeller to substantially restrict forwardly advancing movement of larger particles of the material bodies to movement within said sling compartments, and means for introducing and flowing a fluid body along said fourth zone in such a manner as to separate out particulates of the material bodies of a desired size from the materials being advanced from said third zone into said fourth zone and to then outwardly remove the particulates of such desired size from the fourth zone of the apparatus.

13. A comminuting apparatus as defined in claim 12 wherein said second zone comprises about two quadrants, said third zone comprises about one quadrant, and said fourth and first zones comprise about one quadrant of said housing.

14. A comminuting apparatus as defined in claim 12 wherein the clearance spacing defined between said housing and said impeller along said second zone is within a range of about 0.0005 to 0.0125 of an inch, and said zone extends along about two quadrants of said housing and with respect to rotative movement of said impeller.

15. A comminuting apparatus as defined in claim 12, wherein, said projecting means slopes forwardly downwardly in a substantially tangential relationship with respect to said impeller and defined a forward end of said third zone and a back end of said fourth zone as based on the direction of rotation of said impeller, and a forward end portion of said projecting means provides the relatively close clearance defining relation with said impeller.

16. A comminuting apparatus as defined in claim 15 wherein said projecting means is adjustably mounted in said housing to adjust the clearance defining relationship of its forward end portion with respect to outer edges of the radial flutes of said impeller.

17. A comminuting apparatus as defined in claim 12 wherein the clearance spacing defined by said projecting means and the clearance spacing between said housing and said impeller of the second zone are each not more than about 0.0005 to 0.0125 of an inch.

18. A comminuting apparatus as defined in claim 12 wherein, said means for introducing the fluid body has means for controlling the amount of flow of the introduced fluid body to thereby control the size of the particulates that are picked up thereby and then removed from the apparatus.

19. A comminuting apparatus as defined in claim 12, wherein, a fluid and material body introducing inlet is open into said housing at a forward end portion of said fourth zone, and said fourth zone has an enlarged and unobstructed outflow passageway that extends substantially tangentially along and outwardly from the housing in an opposite direction with respect to the rotation of said impeller to receive and outwardly discharge separated out particulates being carried by the fluid.

* * * * *